US007163338B2

(12) United States Patent
McCracken et al.

(10) Patent No.: US 7,163,338 B2
(45) Date of Patent: Jan. 16, 2007

(54) RECLOSABLE PACKAGE HAVING OFFSET PULL TAB FEATURE AND RELATED METHOD OF MANUFACTURE

(75) Inventors: Kenny E. McCracken, Lawrenceville, GA (US); Lewis Albert Haws, Duluth, GA (US)

(73) Assignee: Illinois Tool Works Inc., Glenview, IL (US)

( * ) Notice: Subject to any disclaimer, the term of this patent is extended or adjusted under 35 U.S.C. 154(b) by 492 days.

(21) Appl. No.: 10/671,857

(22) Filed: Sep. 25, 2003

(65) Prior Publication Data

US 2005/0069229 A1 Mar. 31, 2005

(51) Int. Cl.
*B65D 33/16* (2006.01)
*B65D 33/00* (2006.01)

(52) U.S. Cl. ..... 383/61.2; 383/63; 383/64; 383/65; 383/204

(58) Field of Classification Search ..... 383/61.2, 383/203–204, 5, 63–65, 35, 210–211
See application file for complete search history.

(56) References Cited

U.S. PATENT DOCUMENTS 3,556,337 A * 1/1971 Harmon et al. ..... 220/315
4,823,961 A * 4/1989 Griesbach et al. ..... 426/129
4,923,309 A * 5/1990 VanErden ..... 383/5
5,224,779 A 7/1993 Thompson et al.
5,443,154 A * 8/1995 Hustad et al. ..... 206/213.1
5,924,795 A 7/1999 Thompson et al.
6,206,571 B1 * 3/2001 Olin ..... 383/204
6,290,391 B1 * 9/2001 Buchman ..... 383/5
6,467,956 B1 * 10/2002 Tilman et al. ..... 383/61.3
6,609,828 B1 * 8/2003 Schneider et al. ..... 383/204
6,616,333 B1 * 9/2003 Kinigakis et al. ..... 383/64
6,786,640 B1 * 9/2004 Schneider et al. ..... 383/5

* cited by examiner

*Primary Examiner*—Jes F. Pascua
(74) *Attorney, Agent, or Firm*—Ostrager, Chong, Flaherty & Broitman P.C.

(57) ABSTRACT

A tamper-evident reclosable bag having a pull tab feature that facilitates opening of a header by a consumer. The pull tab feature is provided by an offset between the top and bottom webs (or front and rear walls) of the package. One web has a cutout while the other web has a portion that overlaps the cutout. The offset provides a simple means for the consumer to grasp only one of the webs of the package and then pull the webs apart or peel the offset web away from the cutout web. The peeled-away layer can be provided with a line of weakened tear resistance, allowing a section of the header to, at the same time, be torn off the package. After the tamper-evident seal provided by the header is broken, the consumer can open the zipper, gaining access to the contents of the package.

21 Claims, 5 Drawing Sheets

RECLOSABLE PACKAGE HAVING OFFSET PULL TAB FEATURE AND RELATED METHOD OF MANUFACTURE

BACKGROUND OF THE INVENTION

This invention generally relates to reclosable packaging. In particular, the invention relates to reclosable bags having a header that shrouds the zipper for providing a tamper-evident feature.

In the use of plastic bags, pouches and other packages, particularly for containing foodstuffs, it is important that the bag be hermetically sealed and tamper evident until the purchaser acquires the bag and its contents, takes them home, and opens the bag or package for the first time. It is then commercially attractive and useful for the consumer that the bag or package be reclosable so that its contents may be protected. Such bags provide the consumer with the ability to readily store, in a closed, if not sealed, package any unused portion of the packaged product even after the package is initially opened. Flexible plastic zippers have proven to be excellent for reclosable bags, because they may be manufactured with high-speed equipment and are reliable for repeated reuse.

Many reclosable bags comprise a receptacle having a mouth with a slider-actuated zipper installed therein for opening and closing the bag. As the slider is moved in an opening direction, the slider causes the zipper sections it passes over to open. Conversely, as the slider is moved in a closing direction, the slider causes the zipper sections it passes over to close. Typically, a zipper for a reclosable bag includes a pair of interlockable profiled closure strips that are joined at opposite ends of the bag mouth. The profiles of interlockable plastic zipper parts can take on various configurations, e.g. interlocking rib and groove elements having so-called male and female profiles, interlocking alternating hook-shaped closure elements, etc. Reclosable bags having slider-operated zippers are generally more desirable to consumers than bags having zippers without sliders because the slider eliminates the need for the consumer to align the interlockable zipper profiles before causing those profiles to engage.

It is known to provide a zipper package construction that is designed to undergo some permanent change in the package appearance when the package is opened for the first time. In particular, it is known to provide a zipper package with a header (sealed or open at the ends) that extends over and shrouds the zipper, preventing access to the slider. For example, the header may comprise extensions of the front and rear package walls, the extensions being joined at the top of the bag by a seal. The seal may be a peel seal, which may be readily ruptured by a consumer to expose the zipper and slider, or a "hard" seal, the latter being a seal that is not intended to be broken. In the case of a header formed using a hard seal, it is known to provide the package header with one or more lines of perforations, which must be torn open by a consumer to obtain access to the slider. In place of a line of perforations (or to facilitate tearing the package along the line of perforations), it is also known to provide one or more notches at a side edge of the header for starting a tear across the header. In any event, the header must be opened before access can be had to the slider and zipper. If a package evidences a torn header before the package is purchased by a consumer, this should indicate to the consumer that the package has been tampered with, e.g., previously opened.

Zipper package constructions with sealed headers should also have other desirable features. For example, the package should be "user friendly" in the sense that the steps necessary for the initial opening of the package prior to the use of the zipper are obvious or intuitive to the consumer. For certain tough plastics, the header with dual tear lines may be difficult to tear off, especially for persons with insufficient hand strength. Also the zipper package design should allow the package to be formed on conventional packaging equipment with little or no modification of the equipment being required.

BRIEF DESCRIPTION OF THE INVENTION

The present invention is directed to a tamper-evident reclosable bag having a pull tab feature that facilitates separation of the joined webs (or walls) of a header by a consumer. In one embodiment, the pull tab feature is provided by an offset between the top and bottom webs (or front and rear walls) of the package. One web has a cutout while the other web has a portion that overlaps the cutout. The offset provides a simple means for the consumer to grasp only one of the webs of the package and then pull the webs apart or peel the offset web away from the cutout web. After the header walls have been parted, the consumer can open the zipper.

This invention may be applied to any style of reclosable packaging having a header comprising opposing webs joined along the top of the package. The package zipper may comprise either flanged or flangeless zipper strips and may optionally be actuated by a slider. Also the package may have thermoformed features, such as a pocket in the receptacle area for product and/or a pocket in the header area for a slider.

One aspect of the invention is a reclosable package comprising: a receptacle comprising first and second receptacle walls that oppose each other and an interior space disposed between the first and second receptacle walls; a flexible zipper comprising first and second zipper strips that are mutually interlockable, the interior space being enclosed when the zipper is closed; and a header that shrouds the zipper, the header comprising first and second header walls joined to each other in a first zone along a top of the header, and the first header wall having a cutout in a corner of the header so that a portion of the second header wall is offset relative to the first header wall in the corner.

Another aspect of the invention is a reclosable package comprising: first and second sheets of film material sealed together on three sides to form a receptacle having a mouth and an interior space and sealed across at least a portion of a fourth side to form a header that shrouds the mouth; and a flexible zipper shrouded by said header and comprising first and second zipper strips that are mutually interlockable, the first zipper strip being joined to the first sheet and the second zipper strip being joined to the second sheet, the mouth of the receptacle being closed when the zipper is closed, wherein the first sheet has a cutout in a corner of the header so that a portion of the second sheet in that corner is offset relative to the first sheet.

A further aspect of the invention is a method of manufacture comprising the following steps: laying out a bottom film having first and second mutually parallel edges; forming a cutout in the bottom film adjacent the first edge; placing a zipper closer to the first edge of the bottom film than to the second edge but not overlapping the cutout, the zipper being generally parallel to the first and second edges; joining the zipper, as placed, to the bottom film; placing a top film over the bottom film with the zipper therebetween, a portion of the top film overlying the cutout; joining the top film to the zipper; and joining the top film to the bottom film.

Yet another aspect of the invention is a method of manufacture comprising the following steps: forming a cutout along a first edge of a web of film material having a second edge parallel to the first edge; joining a zipper to the web, the zipper not overlapping the cutout; and being generally parallel to the first and second edges; making a reclosable package that incorporates the joined zipper and web, the reclosable package having a header overlying the zipper when the package is upright, with the cutout being located in one corner of the header.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
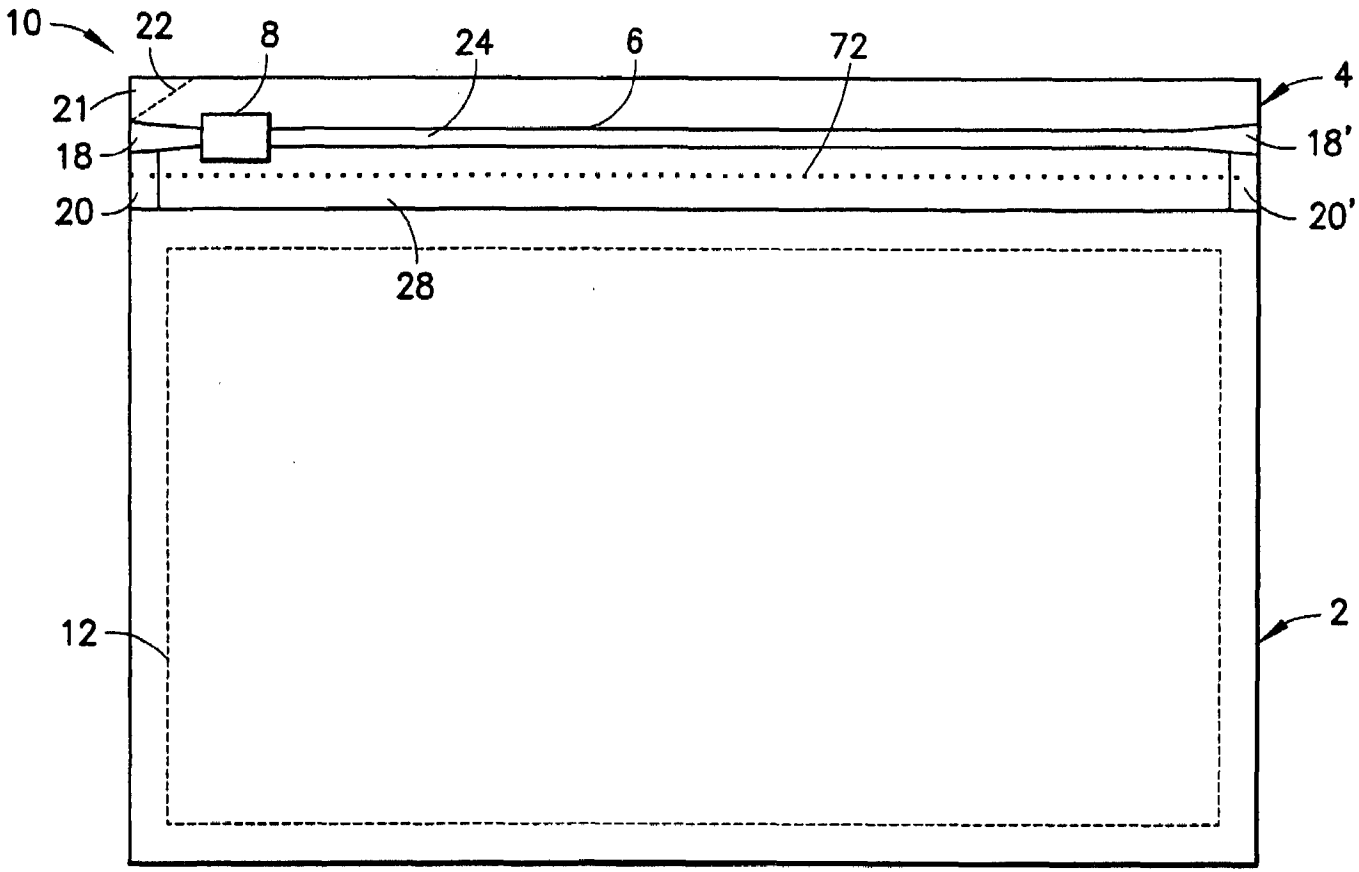
FIG. 1 is a drawing showing a front view of a reclosable package in accordance with one embodiment of the invention.

FIG. 1 shows a top view of a thermoformed package 10 comprising a receptacle 2, a header 4 and a zipper 6 actuated by a slider 8. The header 4 shrouds the zipper, while the zipper is installed in the mouth of the receptacle. The receptacle 2 and the header 4 may be formed by heating sealing top and bottom webs (i.e., webs 14 and 16 seen in FIG. 2) of thermoplastic film material together in a known manner. In this example, it has been presumed that the top web is optically transparent, so that the slider-actuated zipper is fully visible. The rectangle designated by numeral 12 represents a pocket that has been thermoformed in the bottom web. [The rectangle 12 is depicted using dashed lines to reflect that the pocket lies under the top web.] In a typical thermoforming packaging machine, each package-length section of a bottom web is thermoformed to form a respective pocket before a package-length section of zipper with a slider thereon is heat sealed to the bottom web at a distance from the pocket.

The header 4 covers the zipper and acts as a tamper-evident feature. The header may also be used to provide a means for hanging the package on a hook on a display rack, e.g., by forming a hole in the header and sliding the hole onto a hook on a display rack. The package will then depend from the hook until removed by a consumer.

Figure 2:
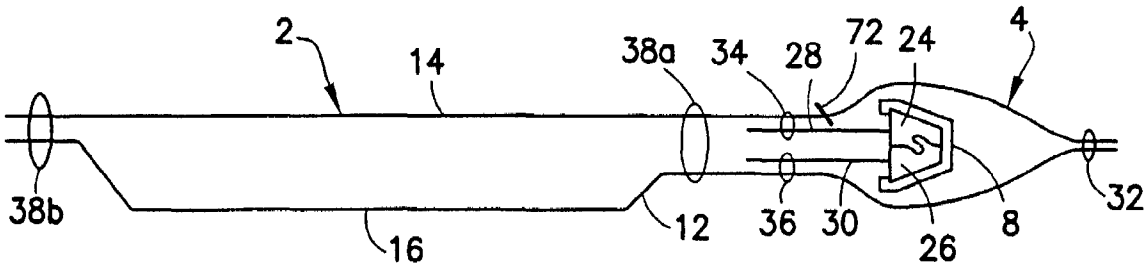
FIG. 2 is a drawing showing a sectional view of the package depicted in FIG. 1. The ovals represent heat seals.

Referring to FIG. 2, the zipper comprises a pair of interlockable zipper strips 24 and 26 having respective flanges 28 and 30 extending from the closure profiles. [Only zipper strip 24 having a flange 28 is visible in FIG. 1, the other zipper strip being directly behind.] Although FIG. 2 shows a rib and groove arrangement, the closure profiles of the zipper strips may take any form. For example, the zipper may comprise interlocking rib and groove elements or alternating hook-shaped closure elements. The zipper material may be made of polyethylene or other suitable thermoplastic material.

As seen in FIG. 1, the zipper has slider end stops 18, 18' and flange seals 20, 20' at respective ends thereof. The zipper profiles are fused together at the end stops, while the zipper flanges are fused together at the flange seals. The end stops 18, 18' perform dual functions, serving as stops to prevent the slider from going off the end of the zipper and also holding the two zipper profiles together to prevent the bag from opening in response to stresses applied to the profiles through normal use of the bag. The flange sealing provides resistance to package leakage and also improves package strength by reinforcing the side welds. The zipper assembly in the embodiment shown in FIG. 1 may have the structure disclosed in detail in U.S. patent application Ser. No. 10/439,847, entitled "Method and Apparatus for Sealing Flanges and Deforming Profiles of Plastic Zipper".

The slider for opening or closing the reclosable zipper is generally shaped so that the slider straddles the zipper profiles. The slider may be constructed with or without a separating finger (also called a "plow"). The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

Figure 6:
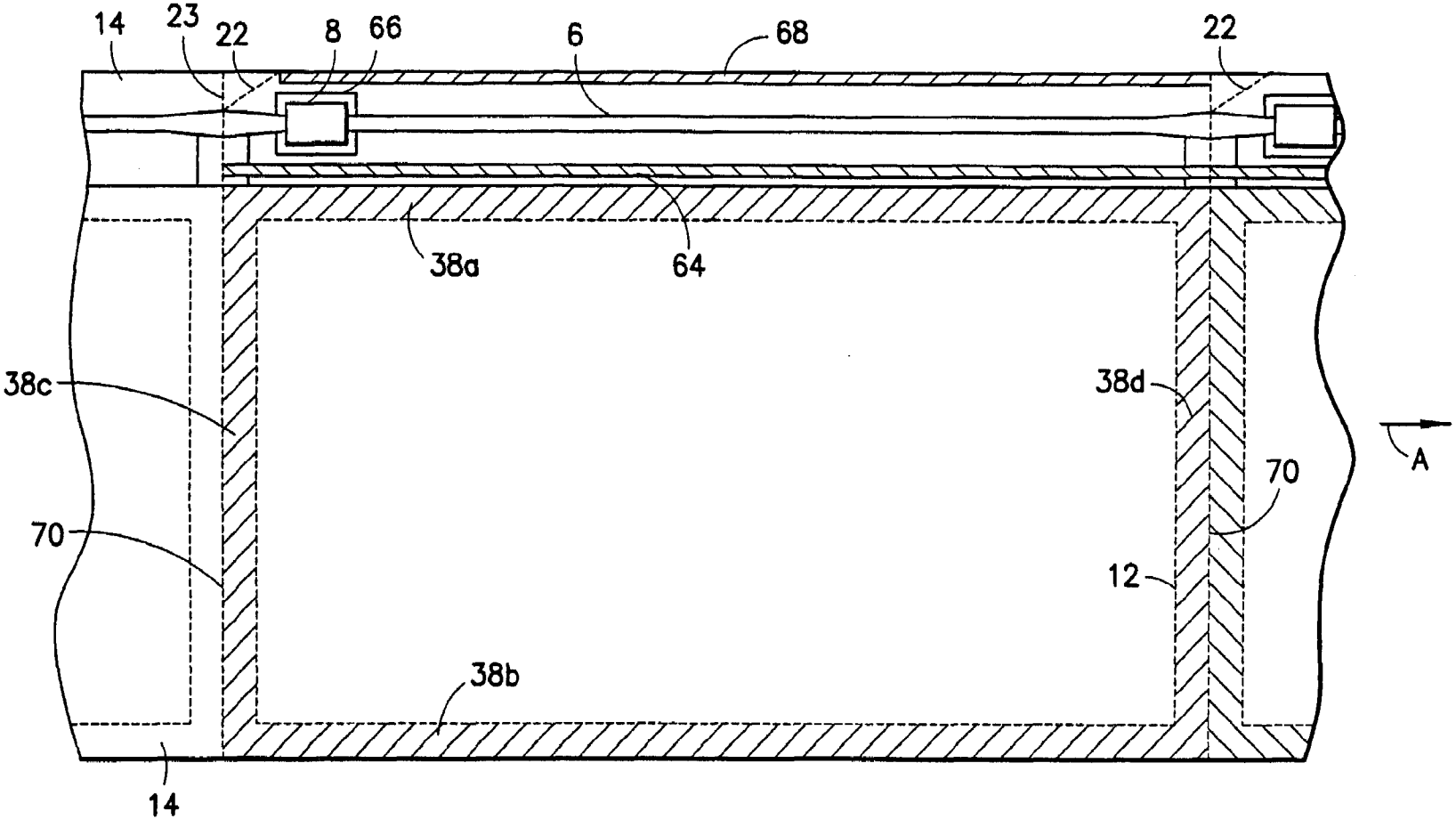
FIG. 6 is a drawing showing a top view of a later stage in the manufacture of the reclosable package depicted in FIGS. 1 and 2.

As best seen in FIG. 2, the package is constructed by heat sealing the top and bottom webs 14, 16 to each other and to the zipper flanges 28, 30. The heat seals are indicated by ovals in FIG. 2. The oval designated by numeral 32 represents a heat seal joining marginal portions of the top and bottom webs at the peak of the header; the oval designated by numeral 34 represents a heat seal joining the top web 14 to the zipper flange 28; the oval designated by numeral 36 represents a heat seal joining the bottom web 16 to the zipper flange 30; and the ovals designated by 38*a* and 38*b* respectively represent two sides of a rectangular heat seal. The four sides 38*a* through 38*d* of the rectangular heat seal are shown in FIG. 6.) This rectangular heat seal is continuous and joins the top and bottom webs along the entire perimeter of the thermoformed pocket 12, thereby forming a hermetically sealed receptacle for product. The ends of the header are not (but could be) sealed.

Returning to FIG. 1, a pull tab feature in accordance with one embodiment of the invention is formed by a cutout in one corner of the bottom header wall. The cut line forms an edge 22, which line is dashed to reflect that the cutout and edge 22 are part of the bottom header, which lies under the top header wall in the view given in FIG. 1 In this particular embodiment, the cutout is represented as a triangle, but other shapes can be used, such as a quarter circle, a trapezoid, or a rectangle. In each case, a portion, i.e., "tab", 21 of the top header wall extends beyond the edge 22 of the bottom header wall and overlies the cutout space. The consumer can grasp the tab 21 between an index finger and opposing thumb and then peel the top header wall away from the bottom header wall. Peeling will start at the edge 22 of the bottom header wall. Once separation of the top and bottom header walls has been initiated, the consumer can then grasp more of the top header wall and pull the grasped end of the top header wall across the package toward the other end of the header. During this action, the top header wall peels away from the bottom header wall along a low-peel-strength header seal (item 68 in FIG. 6) and also tears along a line of weakened tear resistance, i.e., tear line 72 (see FIG. 1), formed in the top header wall. The tear line 72 runs parallel to the zipper 6 at an elevation below the zipper profiles and below the slider 8, so that the slider 8 is exposed when the top header wall is torn off. However, the tear line could be higher so that the slider is only partially exposed. The tear line should be above the line of attachment of the zipper flange (item 28 in FIG. 5) to the package so that the header wall is not also attached to the package. The tear line 72 could be a line of spaced perforations, a scoreline, a line of exposure to a weakening agent (whether radiation or chemical), or equivalent means. Once a major portion of the top header wall has been torn off, the consumer can push the bottom header wall out of the way and proceed to manipulate the slider to open the zipper.

Optionally, the bottom header wall is similarly provided with a tear line running the length of the header. After the major portion of the top header wall has been torn off, the consumer may proceed to tear off a corresponding major portion of the bottom header wall. The pull tab feature, in combination with tear lines, enables the consumer to remove the top header wall first and then the bottom header wall, instead of removing both at the same time. Removing one header wall at a time is easier than removing both sides of the header concurrently, especially for consumers with a weak grasp.

Figure 5:
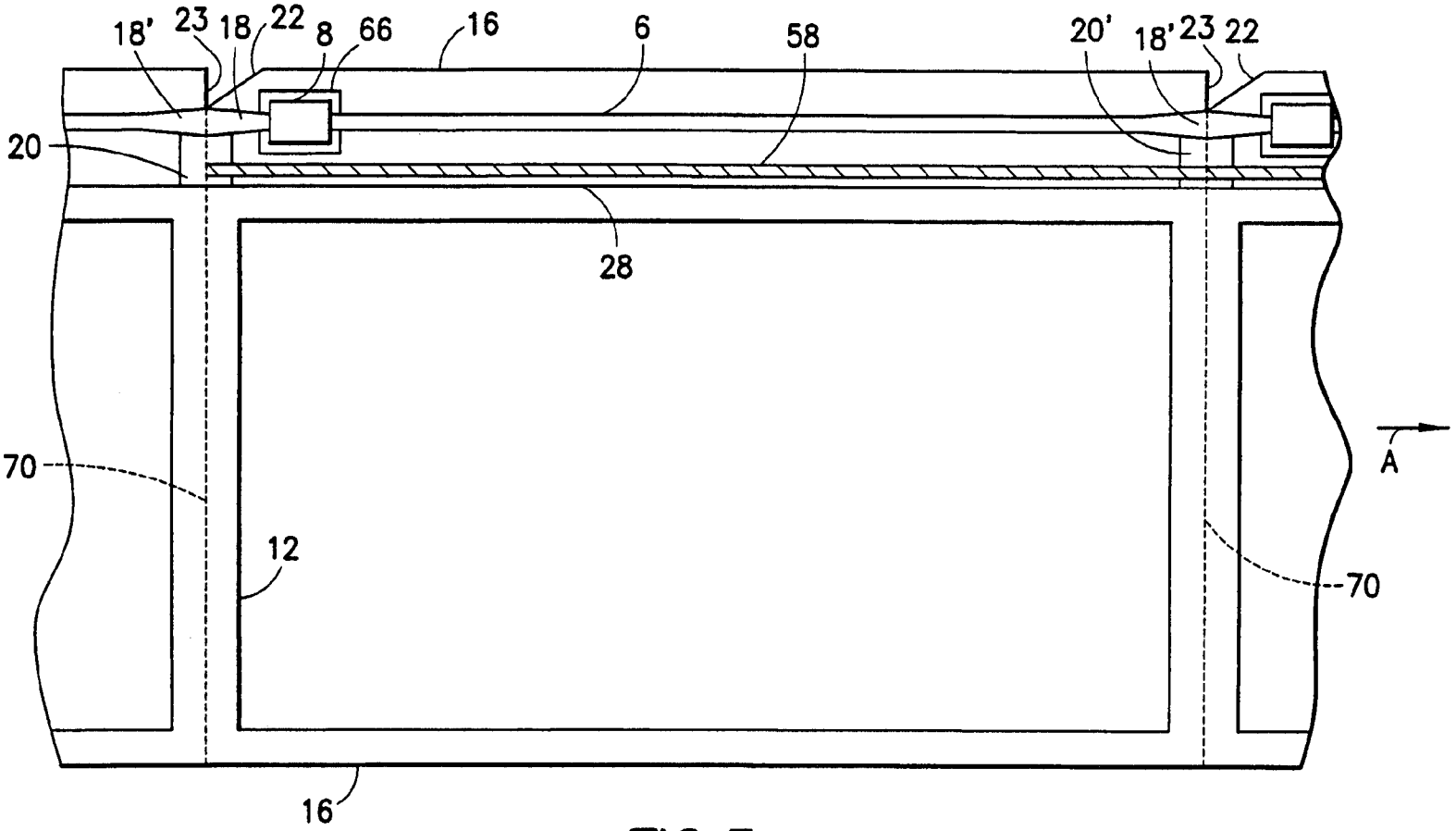
FIG. 5 is a drawing showing a top view of one stage in the manufacture of the reclosable package depicted in FIGS. 1 and 2.

FIGS. 5 and 6 depict two stages in the manufacture of the package of FIG. 1. FIG. 5 shows a portion of an elongated continuous bottom web 16 of film material, oriented in a horizontal plane, that has been unwound from a supply reel and then advanced, one package length per advance, through a pocket thermoforming station, a zipper sealing station and a cutout station (which stations are not shown in the drawings). The stage depicted in FIG. 5 occurs upstream of the position whereat the top web will be laid on top of the bottom web. During each dwell time (between advances), a large pocket or trough 12 for receiving a product and a small pocket 66 for receiving part of a slider 8 are formed in respective thermoforming dies (not shown) by application of heat and vacuum; a triangular cutout 22 is formed at the cutout station, e.g., by cutting along lines 22 and 23, which intersect at a vertex of the triangle; and a package-length section of zipper carrying a slider is sealed to the bottom web 16 along a portion laterally offset from the pocket 12. The hatched band-shaped zone 58 represents the location where the flange of the lower zipper strip is heat sealed to the bottom web 16. Bearing in mind that the zipper is on its side during passage through the packaging machine, item 28 in FIG. 5 represents the flange of the upper zipper strip. Therefore, it should be appreciated that band 28 represents a permanent heat seal between the flange of the bottom zipper strip and the bottom web, with the flange of the top zipper strip overlying the flange of the bottom zipper strip.

As a result of the foregoing V-shaped cut, a portion of the bottom web in the shape of a right triangle is removed. This operation is repeated once per package-length section of the bottom web. For each cutting operation, the cut line 23 is generally perpendicular to the adjacent edge of the bottom web and co-linear with the dashed line 70, which extends in the cross direction and represents where the cuts will be made to sever each completed package from the continuous workpiece at a location downstream. In contrast, the cut line 22 is inclined at an acute angle relative to the cut line 23 and forms the hypotenuse of the triangle. As previously noted, however, the shape of the cutout need not be triangular. It could alternatively be a quarter circle, a trapezoid, a rectangle, etc.

In accordance with the embodiment depicted in FIGS. 1 and 5, only one end of the header on each package is provided with the pull tab feature. Alternatively, both ends of the header could be provided with pull tabs. In the latter event, then a portion of the bottom web 16 would be cutout on both sides of the dashed line 70 in FIG. 5. This can be accomplished by making one cutout in the shape of an equilateral triangle, each half of the equilateral triangle being congruent to the right triangle seen in FIG. 5.

FIG. 6 shows a stage in the manufacturing process after product (not shown) has been placed in the pocket 12 of the bottom web and after a top web 14 has been unwound from a supply reel, laid on top of the bottom web and heat sealed to the latter and to the zipper. For the purpose of illustration, it is assumed that the top web is made of optically transparent thermoplastic material, so that the zipper and slider are visible in FIG. 6. The hatched rectangular perimeter comprising sides respectively designated 38*a* through 38*d* I FIG. 6 represents a continuous zone wherein the top web 14 is heat sealed to the bottom web, thereby hermetically sealing the pocket 12. Typically, the pocket is evacuated before this hermetic seal is formed. Above the hermetic seal 38*a*–38*d*, the hatched band-shaped zone 64 represents the location where the flange of the upper zipper strip is heat sealed to the top web 14. Typically, seal 64, shown in FIG. 6, would overlie seal 58, shown in FIG. 5. Finally, the hatched band-shaped zone 68 adjacent one edge of the top web represents the location where marginal portions of the top and bottom webs are heat sealed to each other, thereby forming a header that is open at both ends.

To avoid clutter in the drawing, FIG. 6 does not show the line of weakened tear resistance (item 72 in FIG. 1) that is provided in the top web 14 to facilitate tearing off the front header wall, as previously described.

The broad scope of the invention further encompasses the idea of substituting a line of weakened tear resistance (e.g., a line of spaced perforations or a scoreline) for the cut 22. Instead of a cutout, the result is that the corner of the header wall is left attached to the rest of the header wall by means of material along the line of weakened tear resistance. This material can be easily torn away and remains attached to the other header wall as the latter is being removed. In accordance with this embodiment, in the low-peel-strength header seal 68 (see FIG. 6) extends to the edge of the header, i.e., the front and rear header walls are joined together in the corner.

Figure 4:
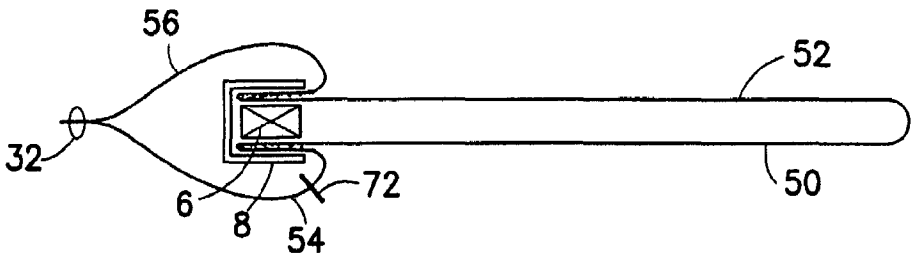
FIG. 4 is a drawing showing a sectional view of a reclosable package in accordance with a further embodiment of the invention.
Figure 3:
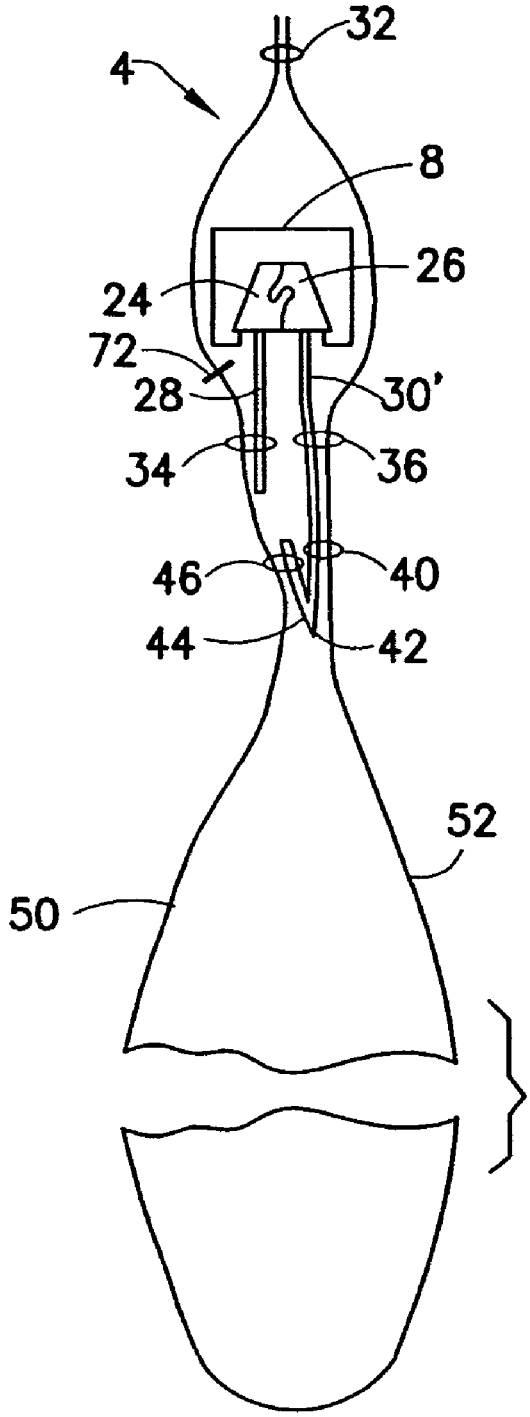
FIG. 3 is a drawing showing a sectional view of a reclosable package in accordance with another embodiment of the invention.

The present invention can be incorporated in any reclosable package having a header formed by opposing header walls that are heat sealed together to form the apex of the header. Preferably, the header heat seal has a peel strength that allows the respective webs to be peeled apart in the manner disclosed herein. Two examples of reclosable packages that may be provided with the pull tab feature disclosed herein are depicted in FIGS. 3 and 4. Each of these packages has a receptacle comprising a folded web that is sealed at the sides, with the fold at the bottom.

FIG. 3 shows a reclosable bag wherein a web of film has been folded and sealed at the sides to form a receptacle with opposing walls 50 and 52 and a header 4. Opposing marginal portions of the folded web are joined by a heat seal 32 (again represented by an oval) to form the apex of the header. The reclosable bag further comprises a zipper operated by a slider 8. The zipper comprises a pair of interlockable zipper strips 24 and 26 having respective flanges 28 and 30' extending from the closure profiles. The oval designated by numeral 34 represents a permanent heat seal joining the bag wall 50 to the zipper flange 28. The zipper flange 30', which is longer than flange 28, is secured to bag wall 52 by permanent heat seals 36 and 40. Flange 30' is also joined to bag wall 50 by a permanent heat 46, which is located below the seal 34. It should be appreciated that each of the seals 34, 36, 40 and 46 is a band of joined, e.g., fused, material that extends from one side seal of the bag to the other side seal, thereby securing the zipper to the bag along the width of the bag.

Zipper flange 18, which is longer than flange 32, is secured to the bag front wall 10 by permanent seals 20 and 22 proximal to the bag top. Flange 18 is further secured to the bag rear wall 10 by a permanent seal 28, which is located below the seal 34. It should be appreciated that each of the seals 20, 22, 28 and 34 is a band of joined, e.g., fused, material that extends from one side seal of the bag to the other side seal, thereby securing the zipper to the bag along the width of the bag. 8.

One or both of the corners (not shown in FIG. 3) of the header 4 may have the pull tab feature of the present invention. In this example, it is assumed that wall 50 has the offset while wall 52 has the cutout. Therefore, FIG. 3 shows that wall 50 is provided with a line of weakened tear resistance 72 at an elevation below the slider, to facilitate tearing off of a major portion of the header wall that forms part of bag wall 50. After the header has been breached in this manner, the consumer can move the slider to open the zipper.

After the header is removed and the zipper is initially opened by a consumer, the flange 30 still prevents access to the package contents. The intact flange 30 provides hermetic sealing. A line of weakened tear resistance is provided at the cusp 42 of the flange 30. By bearing down on the flange 30 or pulling the zipper strips apart, the line of weakness at cusp 42 can be ruptured, thereby providing access to the contents. If the tear line comprises perforations, the barrier posed by flange 30 can be maintained prior to rupture by capping the line of perforations with a frangible strip (not shown in FIG. 3) of lightweight material, as disclosed in U.S. Pat. No. 5,023,122. This frangible strip seals the perforations, but tears readily when the perforated flange is ruptured along the perforations.

Another example of a reclosable bag with a header suitable for incorporating the pull tab feature of the present invention is shown in FIG. 4. In this embodiment, a web of film is folded into the shape of an M; then a string zipper 6 is inserted between the upper folds. The respective double layers of film on opposing sides of the string zipper are heat sealed to the backs of the respective flangeless zipper strips (not shown). Then a slider is inserted onto the string zipper, with the sealed double layers disposed between the respective backs of the zipper strips and the respective side walls of the slider. The inner legs 50 and 52 of the folded web form the opposing walls of the receptacle, while the outer legs 54 and 56 are folded over the zipper and then their edges are heat sealed to form the apex of a header. The heat seal, which is indicated by oval 32, should have a low peel strength. Again, such a construction lends itself to inclusion of the pull tab feature of the present invention because the header walls can be pulled apart. A tear line 72 can be provided on the header wall that incorporates the pull tab.

Other embodiments will be apparent to persons skilled in the art. In all embodiments, either header wall may have a pull tab, while the other header wall has the cutout.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, tacked, adhered, etc., whether by application of heat and/or pressure, application of ultrasonic energy, application of a layer of adhesive material or bonding agent, interposition of an adhesive or bonding strip, etc. As used herein, the term "cutout" means a space formed by removing a portion of a header wall by any means, including but not limited to cutting, punching or melting.

The invention claimed is:

1. A reclosable package comprising:

a receptacle comprising first and second receptacle walls that oppose each other and an interior space disposed between said first and second receptacle walls;

a flexible zipper comprising first and second zipper strips that are mutually interlockable, said interior space being enclosed when said zipper is closed; and a header that shrouds said zipper, said header comprising first and second header walls joined to each other in a zone that runs along a top of said header, and said first header wall having a cutout in a corner of said header so that a portion of said second header wall forms a free graspable tab that extends beyond the bounds of said first header wall in said corner of said header, said tab including a portion of a side edge of said second header wall, said side edge of said second header wall extending from said top of said header to a bottom of said receptacle.

2. The reclosable package as recited in claim 1, further comprising a slider mounted to said zipper, said slider being movable in a first direction along said zipper for opening said zipper and movable in a second direction along said zipper for closing said zipper.

3. The reclosable package as recited in claim 1, wherein the ends of said header are not sealed.

4. The reclosable package as recited in claim 1, wherein each of said first and second zipper strips is flanged.

5. The reclosable package as recited in claim 1, wherein each of said first and second zipper strips is flangeless.

6. The reclosable package as recited in claim 1, wherein said first receptacle wall and said first header wall are respective portions of a first sheet of film material, and said second receptacle wall and said second header wall are respective portions of a second sheet of film material.

7. The reclosable package as recited in claim 1, wherein said second header wall has a line of weakened tear resistance that extends laterally across at least a portion of the width of said second header wall and at an elevation below interlocked profiles of said first and second zipper strips.

8. The reclosable package as recited in claim 7, wherein said line of weakened tear resistance comprises a multiplicity of spaced perforations.

9. The reclosable package as recited in claim 7, wherein said line of weakened tear resistance comprises a scoreline.

10. The reclosable package as recited in claim 7, wherein said line of weakened tear resistance begins at one side of said second header wall at an elevation below the lowest point of said cutout in said first header wall.

11. The reclosable package as recited in claim 1, wherein one of said first and second receptacle walls has a pocket formed therein, further comprising a product residing in said pocket.

12. The reclosable package as recited in claim 11, wherein said first and second receptacle walls are hermetically sealed to each other along an entire periphery that surrounds said pocket.

13. A reclosable package comprising:

first and second sheets of film material sealed together on three sides to form a receptacle having a mouth and an interior space and sealed across at least a portion of a fourth side to form a header that shrouds said mouth; and a flexible zipper comprising first and second zipper strips that are mutually interlockable, said first zipper strip being joined to said first sheet and said second zipper strip being joined to said second sheet, said mouth of said receptacle being closed when said zipper is closed, wherein said first sheet has a cutout in a corner of said header so that a portion of said second sheet forms a free graspable tab that extends beyond the bounds of said first sheet in said corner of said header, said tab including a portion of a side edge of said second sheet, said side edge of said second sheet extending from a top of said header to a bottom of said receptacle.

14. The reclosable package as recited in claim 13, wherein said second sheet has a line of weakened tear resistance that extends laterally across at least a portion of the width of said second sheet and at an elevation below interlocked profiles of said first and second zipper strips.

15. The reclosable package as recited in claim 13, wherein one of said first and second sheets has a pocket formed therein, further comprising a product residing in said pocket.

16. The reclosable package as recited in claim 15, wherein said first and second sheets are hermetically sealed to each other along an entire periphery that surrounds said pocket.

17. A reclosable package comprising:

a receptacle comprising first and second receptacle walls that oppose each other and an interior space disposed between said first and second receptacle walls;

a flexible zipper comprising first and second zipper strips that are mutually interlockable, said interior space being enclosed when said zipper is closed; and a header that shrouds said zipper, said header comprising first and second header walls joined to each other in a zone that runs along a top of said header, and said first header wall having a first line of weakened tear resistance that extends across a corner of said header from a top edge to a side edge of said header so that a corner portion of said first header wall can be torn away from the remainder of said first header wall when said corner of said header is pulled with sufficient force.

18. The reclosable package as recited in claim 17, wherein said first line of weakened tear resistance comprises a multiplicity of spaced perforations.

19. The reclosable package as recited in claim 17, wherein said first line of weakened tear resistance comprises a scoreline.

20. The reclosable package as recited in claim 17, wherein said first header wall has a second line of weakened tear resistance that extends laterally across at least a portion of the width of said first header wall and at an elevation below interlocked profiles of said first and second zipper strips, and said first line of weakened tear resistance is entirely disposed on a portion of said first header wall that lies above said second line of weakened tear resistance.

21. The reclosable package as recited in claim 20, wherein said zone of joinder is a low-peel-strength seal that allows said first header wall to be peeled apart from said second header wall in said zone of joinder as said corner of said header is pulled toward an opposite corner of said header.

* * * * *